US007735167B2

(12) United States Patent
Kline et al.

(10) Patent No.: US 7,735,167 B2
(45) Date of Patent: Jun. 15, 2010

(54) BED ENCLOSURE

(75) Inventors: Charles Robert Kline, Ontario, CA (US); Roy Seizo Carr, Fontana, CA (US)

(73) Assignee: Posey Company, Arcadia, CA (US)

( * ) Notice: Subject to any disclaimer, the term of this patent is extended or adjusted under 35 U.S.C. 154(b) by 0 days.

(21) Appl. No.: 11/759,385

(22) Filed: Jun. 7, 2007

(65) Prior Publication Data

US 2007/0294827 A1 Dec. 27, 2007

Related U.S. Application Data

(60) Provisional application No. 60/804,160, filed on Jun. 7, 2006.

(51) Int. Cl.
*A47C 29/00* (2006.01)

(52) U.S. Cl. ..... 5/414; 5/424

(58) Field of Classification Search ..... 5/414, 5/600, 110–115, 424; 135/90, 96
See application file for complete search history.

(56) References Cited

U.S. PATENT DOCUMENTS

| | | | | |
|---|---|---|---|---|
| 875,206 | A | | 12/1907 | Osborne |
| 952,879 | A | | 3/1910 | Crocker |
| 1,625,673 | A | | 4/1927 | Nelson |
| 1,657,708 | A | | 1/1928 | Berbig |
| 1,737,664 | A | | 12/1929 | Maness |
| 1,892,913 | A | | 1/1933 | Timm |
| 2,210,342 | A | | 8/1940 | Sater |
| 2,223,568 | A | | 12/1940 | Krasnov |
| 2,612,646 | A | | 10/1952 | Sussman |
| 2,820,468 | A | | 1/1958 | Park |
| 2,847,017 | A | | 8/1958 | Drago |
| 2,907,055 | A | | 10/1959 | Berman |
| 2,931,373 | A | | 4/1960 | Larson |
| 3,703,181 | A | | 11/1972 | Tholen |
| 3,763,507 | A | * | 10/1973 | Propst ..... 5/100 |
| 4,164,797 | A | | 8/1979 | Golembeck |
| 4,198,996 | A | | 4/1980 | Keable et al. |
| 4,304,018 | A | | 12/1981 | McClam |
| 4,489,451 | A | | 12/1984 | Neely |
| 4,521,048 | A | | 6/1985 | Prvanoff |
| 4,616,797 | A | | 10/1986 | Cramer |
| 4,641,387 | A | | 2/1987 | Bondy et al. |
| 4,706,313 | A | | 11/1987 | Murphy |
| 4,852,598 | A | | 8/1989 | Griesenbeck |

(Continued)

FOREIGN PATENT DOCUMENTS

WO WO/2006/017684 A2 2/2006

OTHER PUBLICATIONS

European Application No. 07252291.5-1257/1864638, Search Report dated Mar. 12, 2009.

(Continued)

*Primary Examiner*—Fredrick Conley
(74) *Attorney, Agent, or Firm*—Henricks, Slavin & Holmes LLP

(57) ABSTRACT

A bed enclosure for a hospital bed, the enclosure including a tent with four side walls and a mattress cover, further including two connecting panels at the head end of the tent joining the mattress cover to the tent and allowing the mattress cover to be articulated upward.

21 Claims, 12 Drawing Sheets

U.S. PATENT DOCUMENTS

| | | | | |
|---|---|---|---|---|
| 4,862,534 | A | 9/1989 | Gomez-Marcial | |
| 4,937,903 | A | 7/1990 | Joly et al. | |
| 5,010,611 | A | 4/1991 | Mallett | |
| 5,033,493 | A | 7/1991 | Senchuck | |
| 5,136,741 | A | 8/1992 | Balonick et al. | |
| 5,190,305 | A | 3/1993 | Putman | |
| 5,303,434 | A | 4/1994 | Arnold | |
| 5,384,925 | A | 1/1995 | Vail | |
| 5,494,066 | A | 2/1996 | McMahan | |
| 5,562,115 | A | 10/1996 | Sotelo | |
| 5,609,321 | A | 3/1997 | McClellan | |
| 5,642,750 | A | 7/1997 | Brown et al. | |
| 5,699,820 | A | 12/1997 | Evans et al. | |
| 5,743,412 | A | 4/1998 | Noble | |
| 5,784,732 | A | 7/1998 | Vail | |
| 6,035,466 | A | 3/2000 | Homeyer | |
| 6,065,164 | A | 5/2000 | Swanger et al. | |
| 6,079,678 | A | 6/2000 | Schott et al. | |
| 6,098,218 | A | 8/2000 | Ventura | |
| 6,163,906 | A | 12/2000 | Kay | |
| 6,216,291 | B1 * | 4/2001 | Eads et al. | 5/424 |
| 6,263,529 | B1 | 7/2001 | Chadwick et al. | |
| 6,360,384 | B1 | 3/2002 | Kuempel | |
| 6,381,778 | B1 | 5/2002 | Peterson | |
| 6,487,735 | B1 | 12/2002 | Jacques, II et al. | |
| 6,550,083 | B1 | 4/2003 | LaMantia | |
| 6,634,042 | B2 | 10/2003 | Blossman | |
| 6,644,329 | B2 | 11/2003 | Tomason | |
| 6,687,930 | B1 | 2/2004 | Eads et al. | |
| 6,694,547 | B1 | 2/2004 | Vail | |
| 6,772,458 | B2 | 8/2004 | Ellen et al. | |
| 6,952,844 | B2 | 10/2005 | Danaher | |
| 7,047,991 | B2 * | 5/2006 | Kline | 135/96 |
| 2004/0065361 | A1 | 4/2004 | Pratt et al. | |
| 2005/0217026 | A1 | 10/2005 | Ramirez | |
| 2005/0235418 | A1 | 10/2005 | Jacques | |

OTHER PUBLICATIONS

Advertising flier VAIL Enclosed Bed Systems, "There's Only One Way to Spell Quality", http://www.valibed.com.

Advertising flier for SafeTCare, The Restraint Alternative, SafeTCare Manufacturing Company, 5802 Gardendale, Houston, Texas 77092.

Brochure, Canopy Enclosed Beds From Pedicraff, Pedicraft, P.O. Box 5969, Jacksonville, FL 32247-5969, 4 pages.

Advertising Flyer, Safe-N-Secure Bed Enclosure System, Homecare Solutions, 3614 Kennedy Road, South Plainfield, New Jersey 07080, 1 page.

Internet Cite, "GeriTent, Dedicated to the finest in Patient Safety,", GeriTent Interpnses, Inc. at www.geiitent.com, 7 pages.

Brochure, Vail Enclosed Bed Systems, "Reduce the Cost of Patient Care, without Reducing the Care," Vail Products, Inc. 235 First Street, Toledo, OH 43606, 4 pages.

USPTO File History of U.S. Appl. No. 12/131,217 as of Jan. 9, 2010.

Office Action dated Mar. 15, 2010 in U.S. Appl. No. 12/131,217.

* cited by examiner

BED ENCLOSURE

CROSS-REFERENCE TO RELATED APPLICATION

The present Application claims the benefit of priority from U.S. Provisional Patent Application No. 60/804,160 entitled "Bed Enclosure," which was filed on Jun. 7, 2006, the contents of which are incorporated in this disclosure by reference in their entirety.

BACKGROUND

It is sometimes necessary to physically restrain patients in order to prevent them from falling or from otherwise hurting themselves or others. Physical restraint may be recommended, for example, for patients having dementia or certain other neurological disorders. In the past, such patients were typically restrained with straps or vests. Such restraints, however, can be uncomfortable for the patient and unnecessarily restraining.

An alternative to using physical restraints involves the use of a bed enclosure that restricts egress from a bed. Bed enclosures can provide space for a patient to move his or her limbs freely but prevent unsupervised movement out of the bed. Thus, bed enclosures provide a more humane, safe, and less restrictive environment for a patient.

SUMMARY

The present bed enclosure comprises a hospital bed, a mattress supported on the hospital bed, a tent frame attached to the hospital bed, and a tent attached to and supported by the frame. The tent provides a three-dimensional enclosure for restricting egress from the tent by a patient, and includes a mattress cover for enclosing the mattress. The tent further includes one or more removably attached windows which can be fully or partially detached in order to allow ingress into or egress from the tent by a patient or caregiver.

In a preferred embodiment, one or more tent walls are provided with safety panels for use when tent windows are open. A safety panel can be attached to either a tent wall at a point below a window of the tent wall or to a portion of the mattress cover below such tent wall, and is attached along the horizontal extent of the tent window. The safety panel is also reversibly attachable to material on the tent wall adjacent to the vertical sides of the tent window. Such reversible attachments extend from below the lower edge of the tent window to a point vertically above the lower edge of the tent window. The safety panel, which is preferably formed from a flexible material such as that used to form the tent, functions as an alternative to a side rail to prevent a patient from inadvertently falling out of the tent when the window of the tent is open.

A tent window of the present bed enclosure is preferably removably attached to the tent wall with a zipper, and can be unzipped along at least a lower edge of the window and along two vertical sides. The window can, in this case, be opened by placing the unzipped tent window material on the roof of the tent while the window remains attached to the tent wall along an upper edge. In this embodiment, the tent wall which comprises the window can preferably be completely unzipped in order to facilitate laundering of that portion of the wall, including the window. Alternatively, the tent window can be unzipped from all four sides for ease of washing. The tent windows are preferably made from a mesh material to allow air flow through the tent as well as to allow a patient inside the tent to be seen.

In another aspect, the present bed enclosure comprises a tent having a head end wall, a foot end wall, a right side wall, and a left side wall, each of which comprises a lower edge and two side edges. The side edges of each end wall are joined to at least a portion of one of the side edges of each of the side walls to form a four-sided enclosure. The bed enclosure further includes a mattress cover joined to the lower edge of each of the end walls and side walls which substantially completely covers an upper surface of the mattress. In this embodiment, the enclosure further includes connecting panels in order to allow articulation of the mattress cover while it is attached to the side walls and end walls of the enclosure. In particular, the enclosure comprises a right side connecting panel having a first side attached to a first joining portion of the right longitudinal side of the mattress cover from the head end to a point located distally of the head end, the mattress cover not being attached to the right side wall along this first joining portion; a second side attached to a second joining portion of a right side edge of a lower portion of the head end wall, the right side edge of the head end wall not being attached to the right side wall along this second joining portion; and a third side attached to the right side wall. The third side can be joined to the right side wall either at its lower edge or at a point above its lower edge. The enclosure further includes a left side connecting panel having a first side attached to a first joining portion of the left longitudinal side of the mattress cover from the head end to a point located distally of the head end, the mattress cover not being attached to the left side wall along this first joining portion; a second side attached to a second joining portion of a left side edge of a lower portion of the head end wall, the left side edge of the head end wall not being attached to the left side wall along the second joining portion; and a third side attached to the left side wall. The third side of the left side connecting panel can likewise be joined to the right side wall either at its lower edge or at a point above its lower edge.

DRAWINGS

These and other features, aspects and advantages of the present invention will become better understood with regard to the following description, appended claims, and accompanying figures where:

Figure 1:
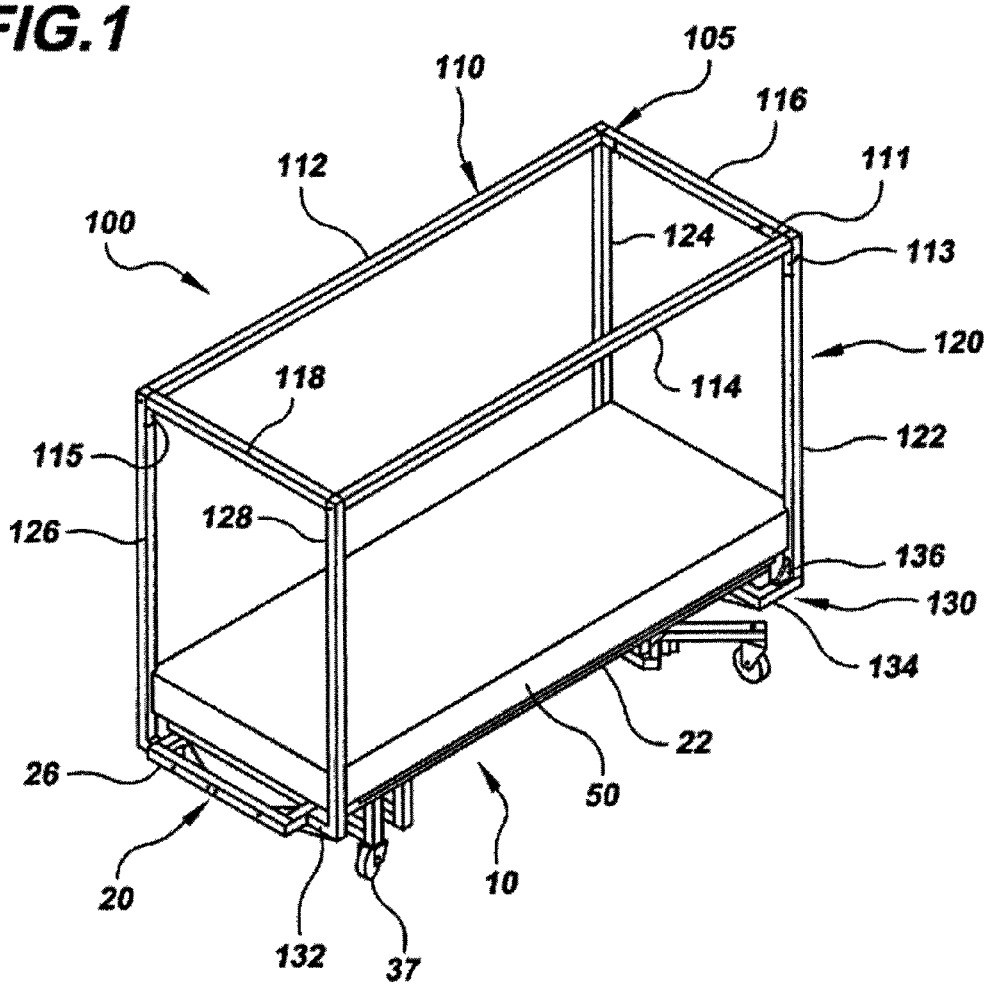
FIG. 1 is a front perspective view of a tent frame attached to a hospital bed, which supports a mattress.

All dimensions specified in this disclosure are by way of example only and are not intended to be limiting. Further, the proportions shown in these Figures are not necessarily to scale. As will be understood by those with skill in the art with reference to this disclosure, the actual dimensions of any device or part of a device disclosed in this disclosure will be determined by their intended use.

DESCRIPTION

Definitions

As used herein, the following terms and variations thereof have the meanings given below, unless a different meaning is clearly intended by the context in which such term is used.

"Horizontal" refers to an orientation approximately parallel to (i.e., not extending away from) a support surface on which the present bed, tent frame, and tent are supported.

"Hospital bed" refers to a bed of the type typically used in a medical care setting which preferably provides functions that facilitate caregiving or increase patient comfort, such as a mechanism for articulating one or more longitudinal ends of a mattress in order to raise the head and/or foot portions of the mattress, a mechanism for raising and lowering the height of the bed, and/or a means for moving the bed. A hospital bed functions as a mattress support for a mattress placed on the bed.

"Seam" refers to a point of connection between two panels of material. Seams are generally formed by connectors, such as zipper connectors or stitches, between different pieces of material. However, panels which are integrally formed, such as through molding, can comprise seams which separate panels only by changes in configuration of such molded material.

"Vertical" refers to an orientation extending toward or away from a support surface on which the present bed, tent frame, and tent are supported.

As used herein, the term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Bed

Any of a number of hospital beds known to the art can be used together with the present tent frame 100 and tent 200. A hospital bed preferably comprises a rigid generally rectangular bed frame 20. The bed frame 20 can be formed, for example, from two longitudinal support members 22 and 24 connected at each end by cross support members 26 and 28 to form a generally rectangular support area. While most bed frames 20 with which bed enclosures are typically used form a generally rectangular shape, it is not necessary that the bed frame 20 of the bed enclosure form a rectangular shape. Cross supports extending between the longitudinal support members 22 and 24, such as cross support 21, can be included in the frame 20 in order to strengthen it.

The bed frame 20 can be supported above a support surface 60, such as a floor of a hospital, acute care facility, long term care facility, home, or other location housing a patient in need of the present bed enclosure, in any way known to the art. Preferably, the bed frame 20 is supported on wheels 37 so that the bed 10, tent frame 100, and tent 200 can be easily moved on such a support surface 60. In the embodiment shown in FIG. 3, the support system 30 for the bed frame 20 comprises four upper vertical supports 31 attached at or adjacent to each end of the longitudinal support members 22 and 24 and extending vertically toward the support surface 60. In some embodiments, such supports 31 can directly contact the support surface 60 or can contact the support surface 60 via a caster 35 and wheel 37 to allow the bed 10 to be more easily moved. However, in the embodiments shown in FIGS. 3 and 4, a mechanism is provided for adjusting the height of the mattress 50, tent frame 100, and tent 200 above the support surface 60. In this embodiment, each upper vertical support 31 is connected to a lower vertical support 33 via two hingedly attached connecting members 36 and 38 (though a single connecting member or a greater number of connecting members can also be used). The height of the portion of the bed frame 20 that supports a mattress 50 is vertically adjustable by vertically articulating the upper vertical supports 31 with respect to the vertical supports 33. A locking mechanism is then engaged to maintain a desired bed height once such height is obtained.

The connecting members 38 are themselves connected by a cross support member 32, and the lower vertical supports 33 are connected at their lower end to a further cross support member 34, which supports the lower vertical supports 33 and connects them to casters 35 located at the ends of the cross support member 34. The cross support member 34 in this way extends the wheel base of the bed 10 and provides greater stability to the tent frame 100 and tent 200. The caster 35 is attached to a wheel 37, which contacts the support surface 60.

The present beds 10 preferably comprise a locking mechanism for securing a bed 10 in a desired location once it has been situated. In one embodiment, one or more of the casters 35 comprises a locking mechanism which can be engaged and thereby prevent the wheels 37 from moving. In an alternative embodiment, shown in FIG. 4, a transfer brake 25 can be used to stabilize the bed 10 in a particular location. The transfer brake 25 can comprise a flange or other structural member extending vertically downward from the upper vertical supports 31 on at least one longitudinal end of the bed frame 20, i.e. extending downwardly from the portion of the upper vertical supports 31 to which the connecting members 38 are attached. In the embodiment shown in FIG. 4, the transfer brake 25 is a vertically extending portion of the same bar which comprises the upper vertical support 31, although the transfer brake 25 can alternatively be a separate bar which is connected to the upper vertical support 31. The illustrated transfer brake 25 thus comprises a bar having a proximal end 23 and a distal end 27, the distal end 27 preferably having a stop made of rubber or other relatively high friction material in order to inhibit movement of the bed 10 on the support surface 60.

Figure 4:
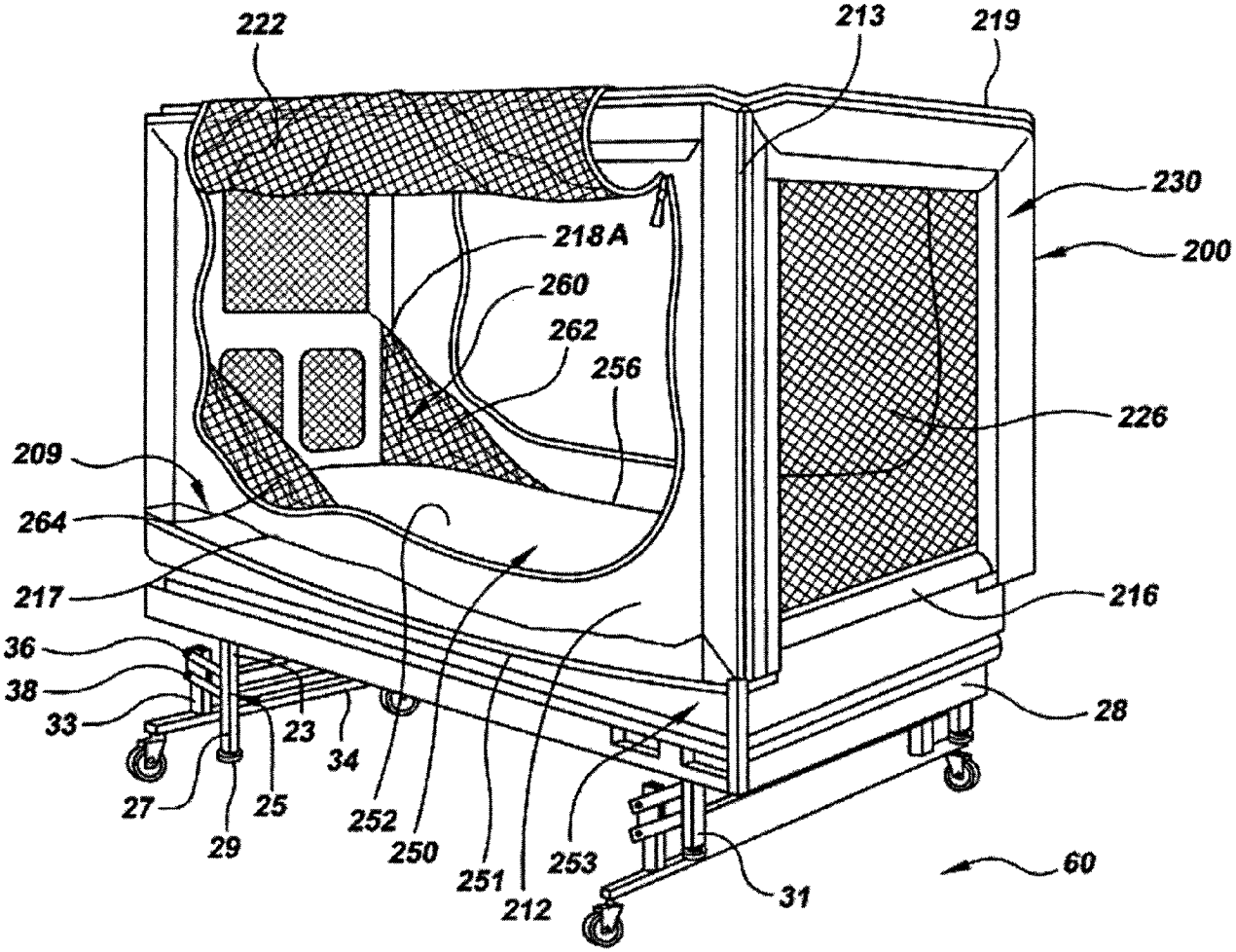
FIG. 4 is a front perspective view of an embodiment the present bed, tent frame, and tent with a panel of the tent in an open position, further showing the interior of the tent.

When it is desired to move a bed 10 of this embodiment, the mechanism for adjusting the vertical height of the bed frame 20 is actuated so that the upper vertical support 31 is raised sufficiently so that the distal end 27 of the transfer brake 25 becomes raised above the floor or other support surface 60 on which the present bed 10 is placed. When it is desired to prevent or inhibit the movement of the present bed 10 with the transfer brake 25, the height adjustment mechanism (preferably operated by a motor) is actuated so as to lower the vertical height of the upper vertical support 31 and of the transfer brake 25 until the distal end 27 of the transfer brake 25 contacts the support surface 60. If transfer brakes 25 are located on only one longitudinal end of the bed 10, then only that end of the bed 10 is prevented from moving, which can aid in preventing tipping of the tent frame 100 and tent 200 by an occupant. If both longitudinal ends of the bed 10 include transfer brakes 25 as illustrated in FIG. 4, then both ends of the bed 10 are immobilized.

The bed 10 also preferably includes a deck or mattress support 40 which articulates in a vertical direction at one or more points along the length of the bed frame 20 in order to allow, for example, a head portion of the mattress 50 to be raised. Various mechanisms known to the art for accomplishing such articulation can be used with the present bed 10.

The components of the bed frame 20 can be made from aluminum, steel, or other suitably rigid materials. In a preferred embodiment, the bed frame components are aluminum for lightweight construction, though casters 35 are typically made from steel.

Tent Frame

The tent frame 100 of the present bed enclosure provides structural support for the tent 200, which comprises opposed side walls and opposed end walls to form a three-dimensional enclosure for a patient. The tent frame 100 preferably is configured to provide support for a tent roof 215 and roughly square or rectangular tent walls 210 (e.g., tent walls 212, 214, 216 and 218). Alternatively, the tent frame 100 can be like that disclosed in U.S. Pat. No. 7,047,991, which comprises a single longitudinal upper support bar. In this embodiment the upper edges of the opposed side walls meet or are otherwise connected and secured to the upper support bar.

As shown in FIG. 1, the present tent frame 100 can comprise horizontal support members 110, namely two upper longitudinal supports 112 and 114 connected at either end to two cross support members 116 and 118. In the illustrated embodiments, the supports 112, 114, 116 and 118 comprise bars having four sides and a square cross section. The supports are connected at each end to vertical support members 120, namely support members 122, 124, 126 and 128.

In a preferred embodiment, the upper longitudinal supports 112 and 114 are connected to the cross support members and vertical support members by means of flanges 105 extending from the ends of the upper longitudinal supports 112 and 114. As shown in FIG. 1, flange 111 extends beyond the end of upper longitudinal support 114 from one side of this support and is attached to cross support member 116, such as with a bolt. Flange 113 likewise extends beyond the end of upper longitudinal support 114 from another side of this support and is attached to vertical support member 122. The upper longitudinal support 114 is thus connected to a cross support and to a vertical support by means of two flanges extending from an end of the upper longitudinal support 114, in this case at approximately a 90° angle. Flanges 105 can also be used to attach the cross support members to the vertical support members, such as flange 115, which extends from an end of cross support member 118 and is attached to vertical support member 126.

At the lower vertical extent of each of the vertical support members 122, 124, 126 and 128, these support members 120 are connected to the bed frame 20. In some embodiments, the vertical support members 120 can be directly attached at their lower ends to the bed frame 20, such as by means of flanges as described above. However, in the embodiment shown in FIG. 1, the vertical support members 120 are attached to a side of the bed frame 20 by lower cross support members 130 in order to provide greater interior space to the tent 200. The lower cross support members 130 can comprise, e.g., a straight member 132 attached to the outer facing side of longitudinal support member 22 at one longitudinal end as shown, e.g., in the FIGS. 1-3, in order to increase the interior tent space along the width of the bed 10. The lower cross support members 130 can alternatively be attached to a cross support member (26, 28), such as through insertion into a corresponding hole in an outer facing side of a cross support member at one longitudinal end, which can increase tent space along the length of the bed 10. In a further alternative, an angled lower support member 134 (also shown in FIGS. 1-3) can be used to attach the vertical support members 120 to the bed frame 20 in order to increase the interior space of the tent along both the width and the length of the bed frame 20. The lower cross support members 130 can preferably further include buttress members 136 extending between a lower cross support member 130 and a vertical support member 120, and/or between two sides of an angled lower support member 134.

The tent frame's components can be constructed of any suitably rigid material, such as metal tubing with a square cross section. A preferred material is extruded aluminum, though other materials such as steel can also be used.

Tent

Figure 2:
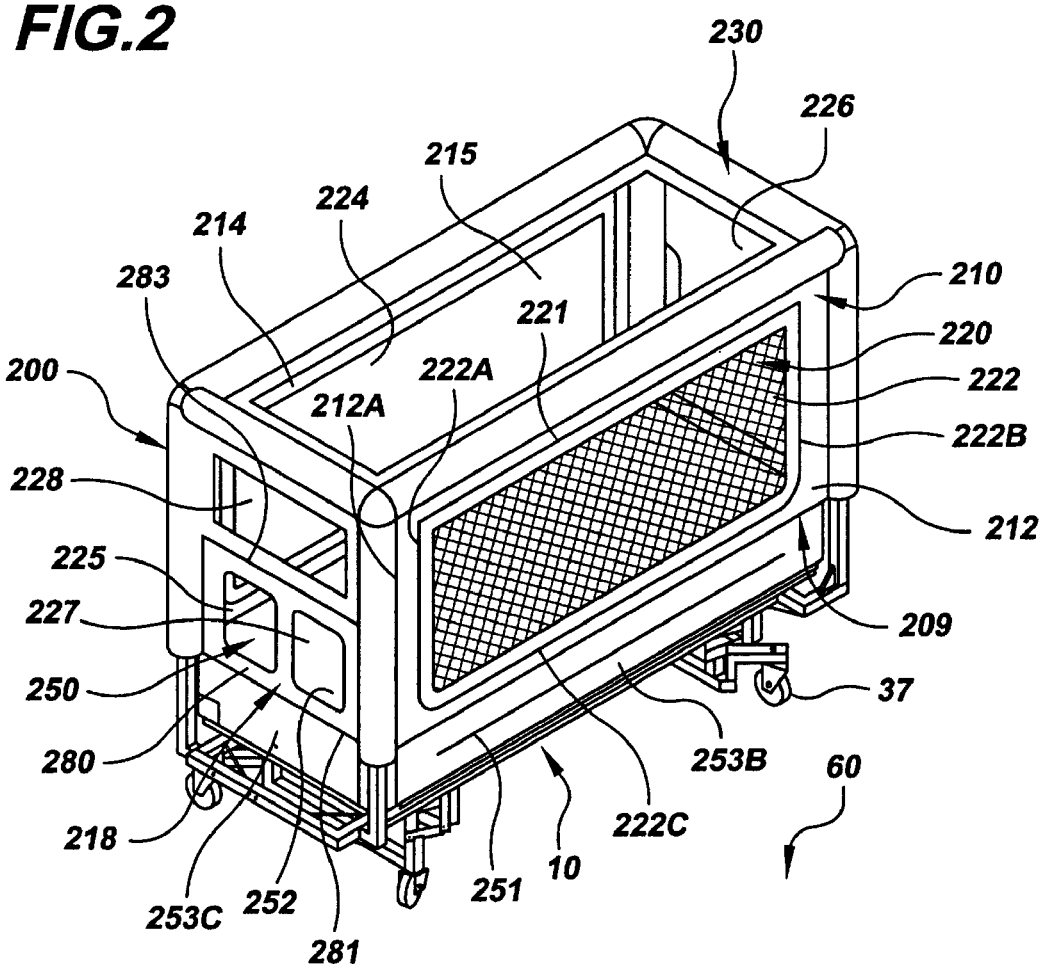
FIG. 2 is a front perspective view of the bed and tent frame of FIG. 1 to which a tent as described herein has been attached.
Figure 3:
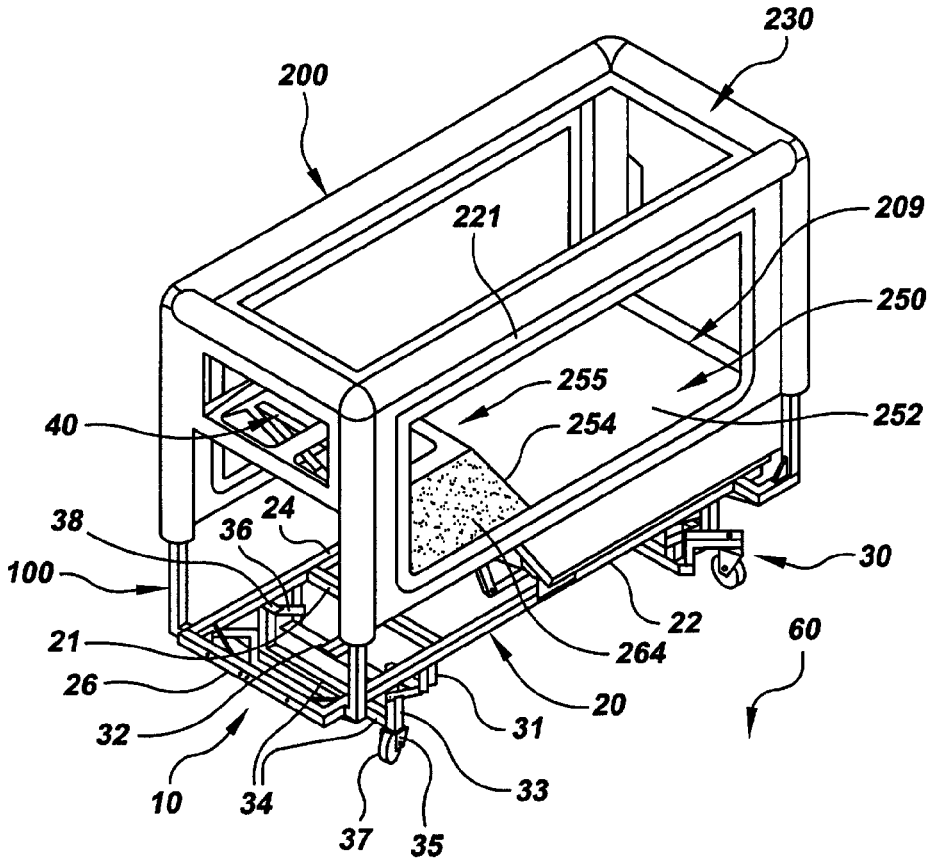
FIG. 3 is a front perspective view of the bed, tent frame, and tent of FIG. 2 showing the head of the bed and mattress in a raised position.

The tent 200 of the present bed enclosure, as previously described, is supported by the tent frame 100 over the bed frame 20. As shown in FIGS. 2-4, the tent 200 comprises opposed side walls, i.e. right side wall 212 and left side wall 214, and opposed end walls, i.e. foot end wall 216 and head end wall 218. The opposed side walls and end walls, preferably together with a tent roof 215, define a three dimensional interior space for containing a patient. As in the illustrated embodiments, the tent walls 210 are preferably square or rectangular and thereby comprise two approximately parallel vertical side edges and two approximately parallel horizontal upper and lower edges. The lower edges 209 of side walls 212 and 214 and end walls 216 and 218 form an open bottom which can be attached to the mattress cover 250.

Figure 13:
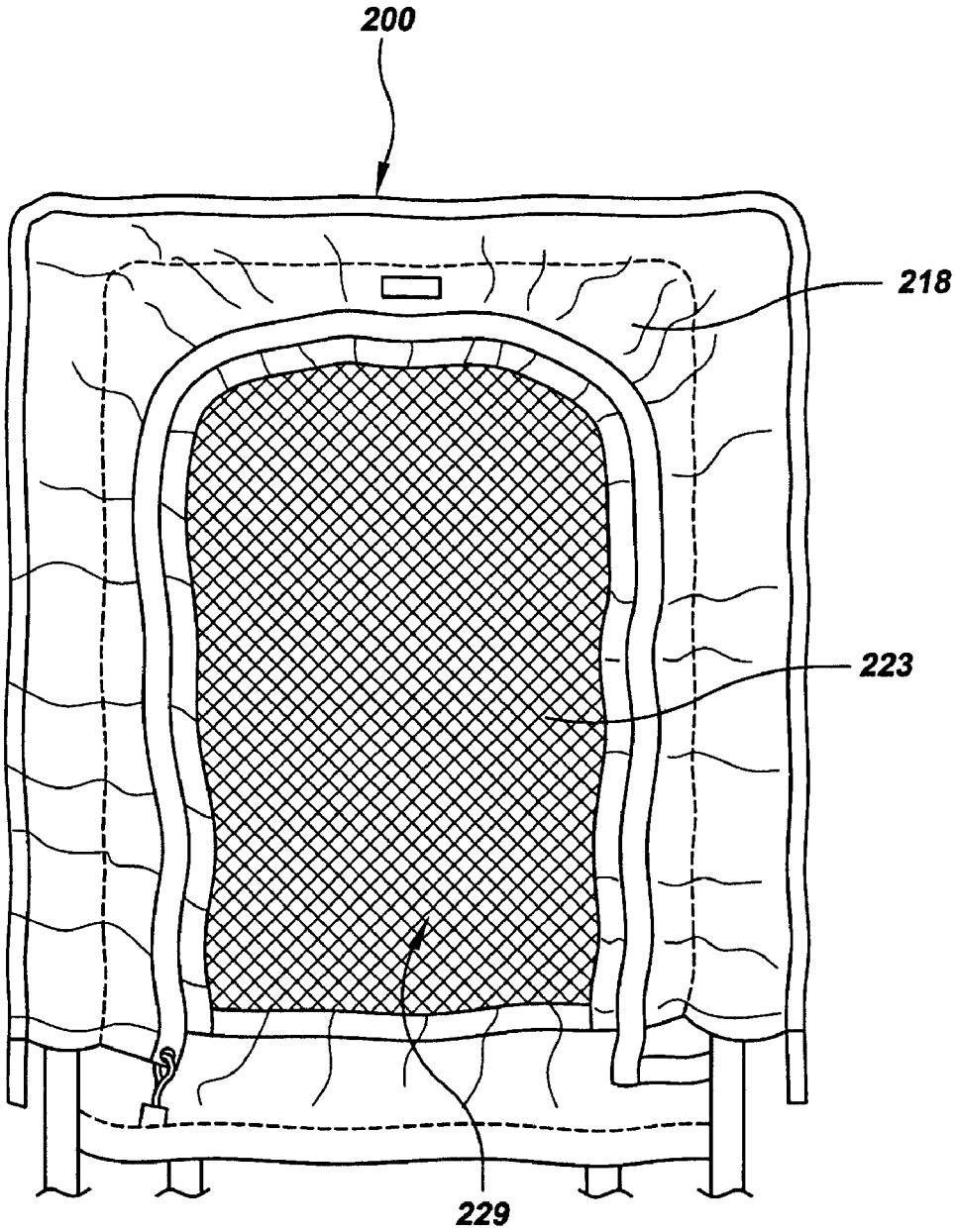
FIG. 13 is a side plan view of the head end of the bed, frame, and tent of FIG. 9.

One or more of the tent walls 210 comprises a removably attached window 220 which can be opened (as shown in FIG. 4) to allow ingress into or egress from the bed enclosure. Windows 220 can be made from materials which allow visibility, light, and/or ventilation through the window material, such as a mesh material. In a preferred embodiment, as shown for example in FIG. 2, each tent wall 210 comprises one or more tent windows 220 (mesh material has been illustrated in tent window 222 in FIG. 2, but the spaces identifying other tent windows as well as the space for tent roof 215 in FIGS. 2 and 3 are shown without such material for clarity). In the embodiment of FIG. 2, tent wall 212 comprises window 222, tent wall 214 comprises window 224, tent wall 216 (the foot end wall) comprises window 226, and tent wall 218 (the head end wall) comprises windows 225, 227 and 228. Tent wall 218 can alternatively comprise a single window 223 as shown in FIG. 13.

The tent 200 can be made of any suitable material, such as vinyl of varying thicknesses, canvas, laminated materials, cotton duck, polyester, heavy denier nylon, propylene, nylon mesh or cotton netting. Tent materials are preferably flexible and lightweight, and in addition are preferably flame retardant, to reduce the risk of fire injury to a patient as well as to meet applicable laws and regulations. Materials used for the tent walls 210 may be opaque, but materials for the windows 220 are preferably see-through or transparent, and more preferably allow the passage of air through them (as with a mesh material).

In embodiments of the tent as shown, e.g., in FIG. 4, each wall 210 of the tent has a lower edge 209 on the open bottom connected to one half of a zipper connector 217 mated with the other half of the zipper connector attached to an upper edge of the mattress cover 250 (or to material attached thereto) to allow the tent walls 210 to be removably connected to the mattress cover 250. Reversible connectors such as zipper connector 213 are also used to attach the tent walls 210 to each other, and a further reversible connector or connectors, such as zipper connector 219, can be used to attach the tent walls to the tent roof 215. The zipper connectors attaching the tent walls and roof to the frame are advantageously positioned outside the enclosed interior of the tent, so that patients in a tent do not have access to them. Through the use of such reversible connectors, each of the tent walls 210 and the tent roof 215 can be separately removed from the tent 200 in order to launder or repair it. Other reversible connectors known to the art, such as a threaded rope, can also be used in place of zipper connectors.

At least one of the tent windows 220 should comprise a reversible connector, such as a zipper, so that the window 220 can be removably attached at least in part to the tent wall 210 comprising such window. A tent window 220 can be completely removable from the tent wall comprising such window, in order to facilitate cleaning of the window, for example. However, in other embodiments the window 220 can be attached to the tent wall 210 along an upper vertical edge 221 with a connector that is not reversible, such as stitching, in which case the window can be opened by lifting the window material and placing it on the tent roof 215, as shown in FIG. 4.

As shown in FIGS. 2-4, sleeves 230, preferably made from the same material as the tent walls 210, surround each of the vertical and horizontal support members of the tent frame 100 of the tent, so that support members 112, 114, 116, 122, 124, 126 and 128 are covered by such sleeves 230. These support members are preferably completely covered in order to prevent patient access to the frame 100. In addition, padding (not shown) is preferably included between the support members and the sleeves 230 in order to prevent a patient from becoming injured through contact with the rigid frame support members, which may be made of metal. The tent walls 210 are preferably connected to the support members 110 of the tent frame 100 by sleeves 230 which are attached to adjacent tent walls 210.

The mattress 50 of the present bed enclosure is enclosed by a mattress cover 250 to which the lower edges of tent walls 212, 214, 216 and 218 are attached. The top and sides of the mattress 50 are preferably substantially completely covered by the mattress cover 250, i.e. such that an occupant of the bed enclosure cannot extend a head or limb through any opening in the mattress cover and thereby gain access to the mattress 50 or the underside of the mattress cover 250, which could pose a risk of entrapment to the occupant. If the mattress cover does not completely cover the mattress 50, the side walls of the mattress cover should be secured to the mattress 50, such as with straps or panels extending between the side walls of the mattress cover 250 under the lower surface of the mattress 50. More preferably, the mattress 50 is completely enclosed by material forming the mattress cover 250. The mattress cover 250 is also preferably reversibly secured to the bed frame with a strap 330.

The mattress cover 250 should be joined to the lower edge of each of the tent walls 212, 214, 216 and 218 in order to form the present bed enclosure, either directly or via intervening panels, such as the connecting panels 260 (described below). The tent walls 210 of the tent 200 are preferably removably attached to the mattress cover 250, such as with one or more zipper connectors. As shown in FIG. 4, the mattress 50 can be removed from the mattress cover 250 via an opening 251 in a side wall 253 of the mattress cover 250. The opening 251 can preferably be closed in a reversible manner, such as with a zipper.

Connecting Panels

Figure 5:
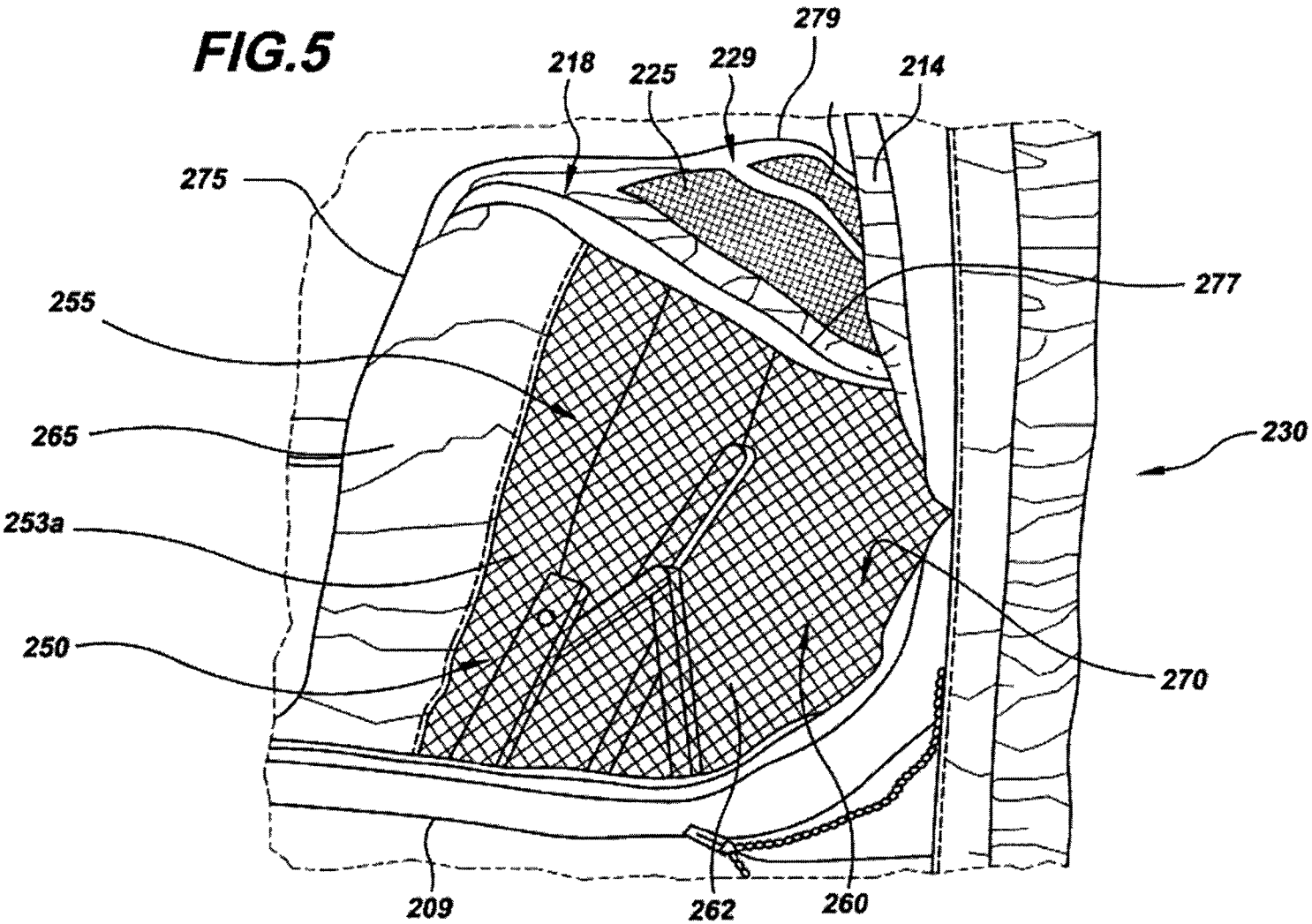
FIG. 5 is partial rear perspective view of the present tent and tent frame showing the head of the bed and mattress in a raised position.
Figure 10:
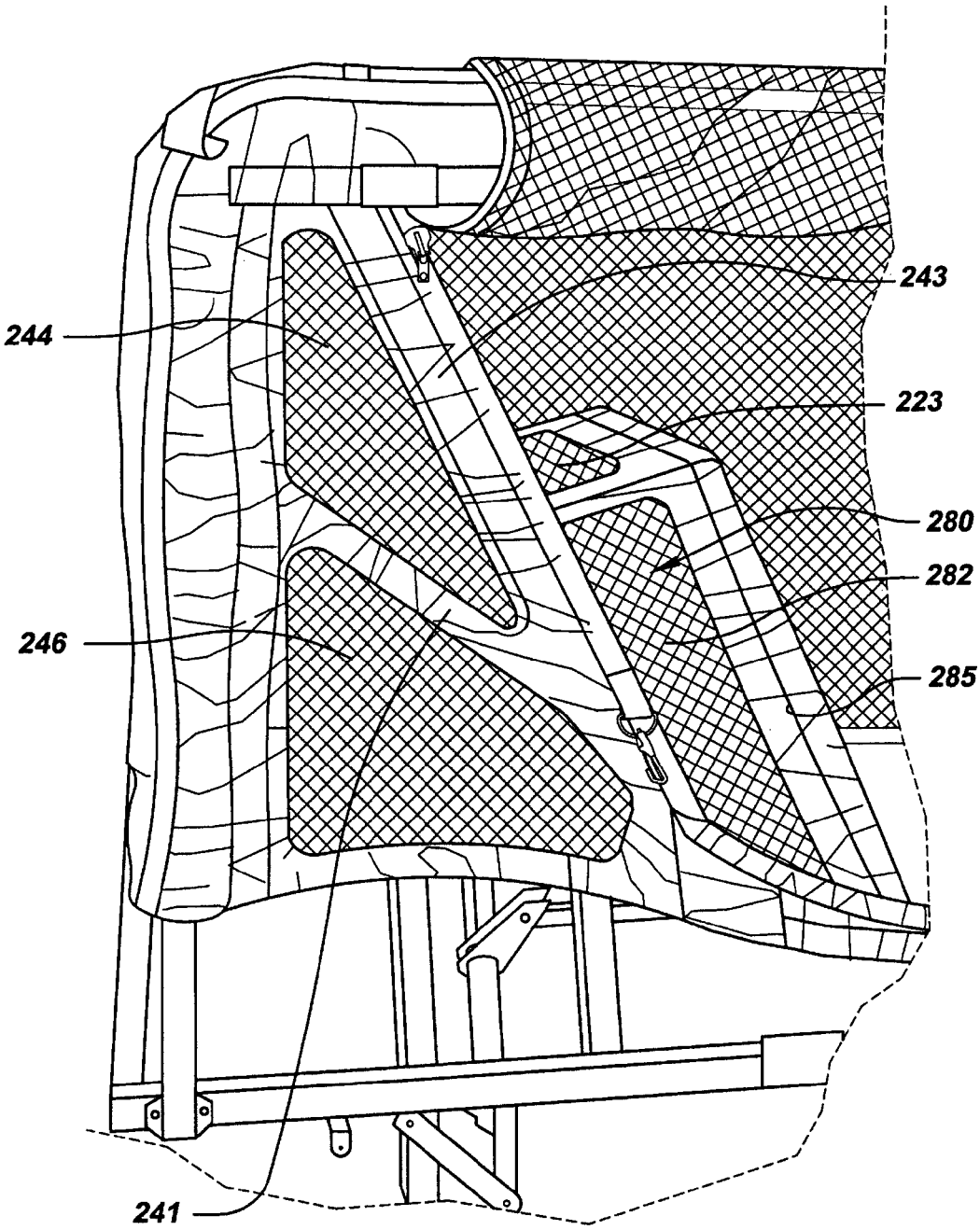
FIG. 10 is a partial front perspective view of the embodiment of FIG. 9.

In a preferred embodiment, one or more ends of the mattress support 40 articulate vertically in order to allow at least one end of the mattress 50, e.g. a head end, to be raised (as shown, e.g., in FIGS. 3, 5, and 10). Articulation of the mattress cover 250 can be accomplished in a bed enclosure in which the horizontal supports (such as upper longitudinal supports 112 an 114) do not change length, such as in the frame of FIG. 1, by providing connecting panels 260 attached to the tent walls 210 and to the mattress cover 250. The connecting panels are preferably triangular in configuration and are attached on a first side to the mattress cover 250, on a second side to a side wall of the tent 200, and on a third side to the adjacent end wall of the tent.

The connecting panels 260 are preferably made from a flexible mesh material or other material allowing the passage of air therethrough, so that an occupant of the bed enclosure who becomes entangled in such material or who becomes pinned to it does not suffocate, although a minor portion of the connecting panels 260, such as portion 265 (see FIG. 5) can be of a different material. The material used to form the connecting panels 260 should also preferably be at least somewhat elastic. In this way, if a patient becomes pinned or lodged between the mesh material and a tent wall, the patient will not experience undue chest compression, due to the elastic resistance of the material of the connecting panel. Such material should therefore be selected so as to have an elastic modulus which allows the breathing musculature of a human subject to deform the material by a sufficient amount to allow the subject to breathe if the chest of the subject is in contact with a connecting panel 260. Tent windows 220 can also advantageously be made of such material.

In one embodiment, shown in FIGS. 3-5, one longitudinal end portion, preferably head end 255, of the mattress cover 250 is connected to the corresponding lower edge of the left side tent wall 214 by a connecting panel 262. The a first side of the connecting panel 262 can be attached to the upper surface 252 of the mattress cover 250, such as along the side edge 256, or can alternatively be attached to side wall 253*a* of the mattress cover 250 and/or to other material which is itself attached either to the upper surface 252 or to a side wall 253*a* of the mattress cover 250. The seam 275 connecting the first edge of the connecting panel 262 to the mattress cover 250 is preferably attached along the entire length of the first edge of the connecting panel 262 to the mattress cover 250. A second side of the connecting panel 262 is then attached to a lower edge of the tent wall 214 at the head end of the bed enclosure. The third side of the connecting panel is then attached to a lower portion of the side edge 218A of tent wall 218 at the head end of the bed enclosure at seam 277. The second and third sides of the connecting panel 262 are likewise preferably attached to their respective side and end wall portions along the entire lengths of the sides of the connecting panel 262.

In a similar manner, the connecting panel 264 can is attached to the lower edge of side wall 212, the lower portion of the corresponding side edge of tent wall 218, and to the mattress cover 250. In order to allow articulation of the mattress cover 250, the connecting panels 260 are made sufficiently large, i.e. with sufficiently long sides, to allow the head end portion 255 of the mattress cover 250 to be raised to a predetermined extent. Preferably, the connecting panels 262 and 264 and the lower portion 229 of tent wall 218 can form taut surfaces when the mattress 50 and mattress cover 250 are fully raised. The windows 225 and 227 of the lower portion 229 preferably comprises a mesh material such as the material used for the connecting panels 260.

Figure 6:
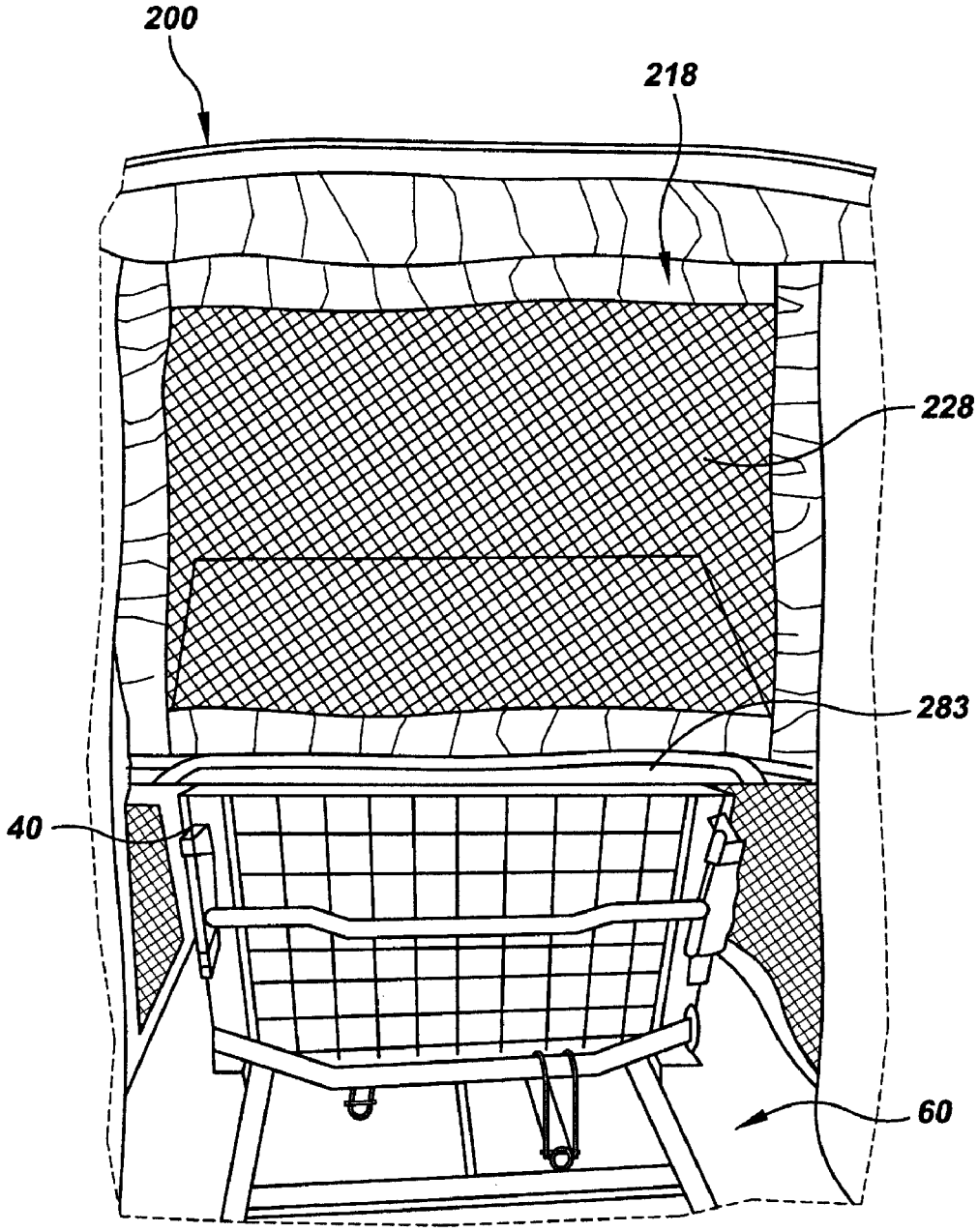
FIG. 6 is a partial side view of the exterior of the raised end of the bed, tent frame, and tent of FIG. 5.

By attaching the mattress cover 250 to the end wall 218 and side walls 212 and 214 in this manner, not only is vertical articulation of the mattress 50 and mattress cover 250 enabled, but a patient in the enclosure is also protected from becoming entrapped underneath the mattress 50, the mattress cover 250, or the support 40. As best seen in FIG. 5, when the mattress 50 and mattress cover 250 are raised, as shown in FIGS. 3, 5, and 6, the pieces of connecting panels 262 and 264 and the lower portion 229 of the end wall 218 together form a barrier preventing patient access to the underside of the mattress 50, the mattress cover 250, and the support 40 when these components of the bed enclosure are raised.

Figure 9:
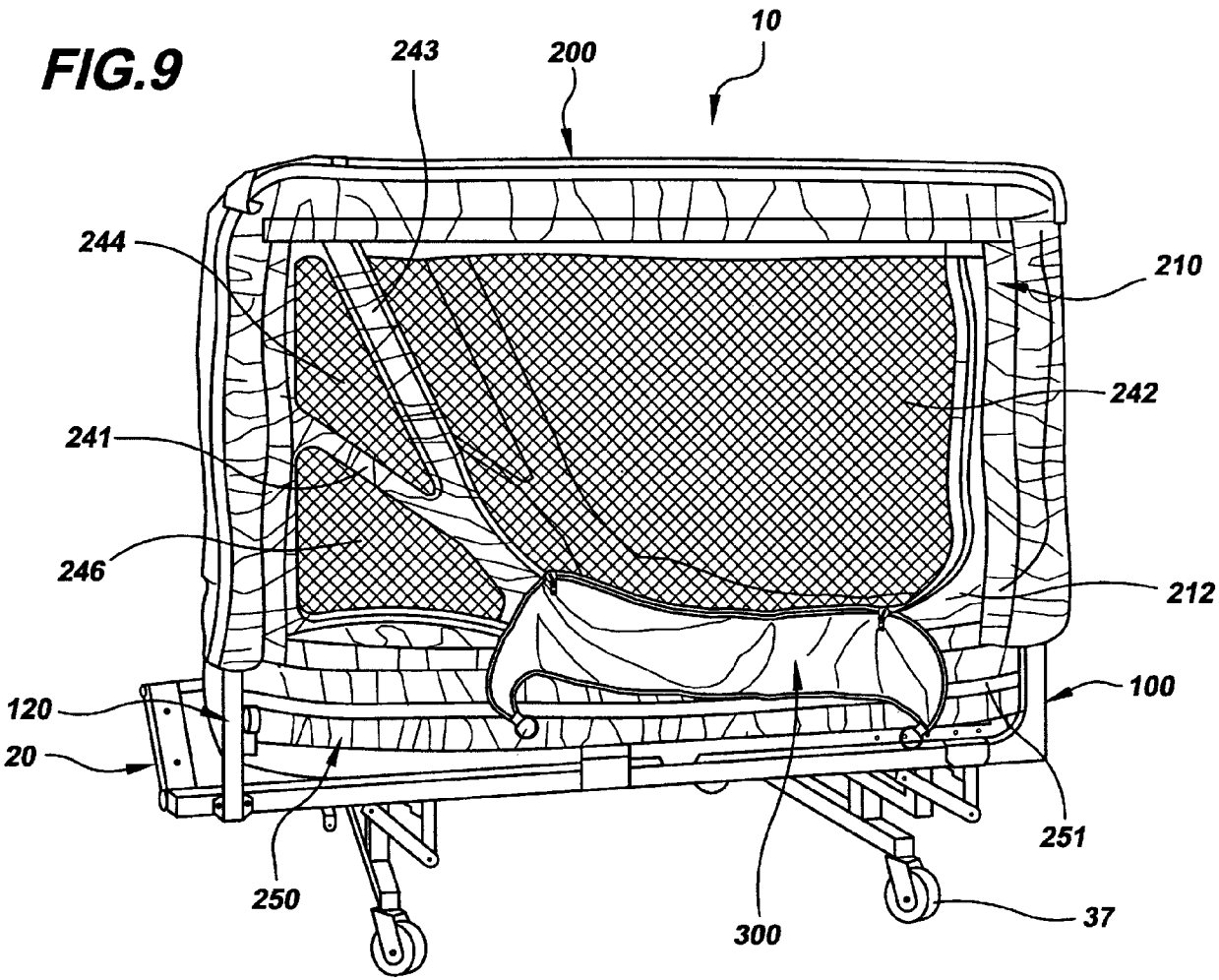
FIG. 9 is a front perspective view of an alternative embodiment of the present bed, frame, and tent.

In a further preferred embodiment, shown in FIGS. 9-12, the connecting panels 260 are attached to the side walls of the tent 200 not at their lower edge but along a seam located above the lower edge of the side walls. As illustrated in FIG. 9, this seam is present in a separation panel 241 of the side wall 212. Above and below the separation panel 231 are an upper border window 244 and a lower border window 246, which preferably comprise a mesh material as described above with respect to the material used for the connecting panels 260, in order to allow an occupant of the bed enclosure to breathe in case the occupant becomes lodged between the articulated head end of the mattress cover 250 and the side wall 212. A border panel 243 between the upper border window 244 and the main tent window 242 is further provided, so that connectors (e.g., zipper connectors), can be attached to the border panel and thereby allow the main tent window 242 to be reversibly secured to the side wall 212.

Figure 11:
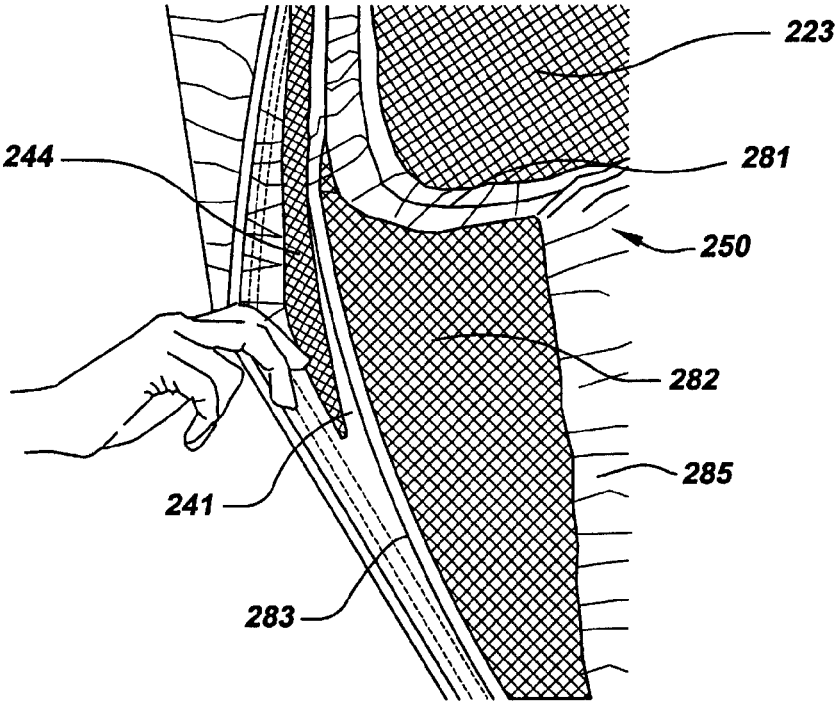
FIG. 11 is a partial front perspective view of the interior of the embodiment of FIG. 9 with the head end of the mattress raised.

FIGS. 10 and 11 further illustrate the attachment of a right side connecting panel 280 comprising mesh material 282 attached along seam 285 to the head end of the mattress cover 250 and along seam 281 to the head end wall 218. Seam 283 joins the third side of the connecting panel 280 to the right side separation panel 241, which extends from a lower portion of the side wall 212 located distally of the head end of the bed enclosure both upwardly and toward the head end of the bed enclosure until it meets the side edge of the side wall 212.

Figure 12:
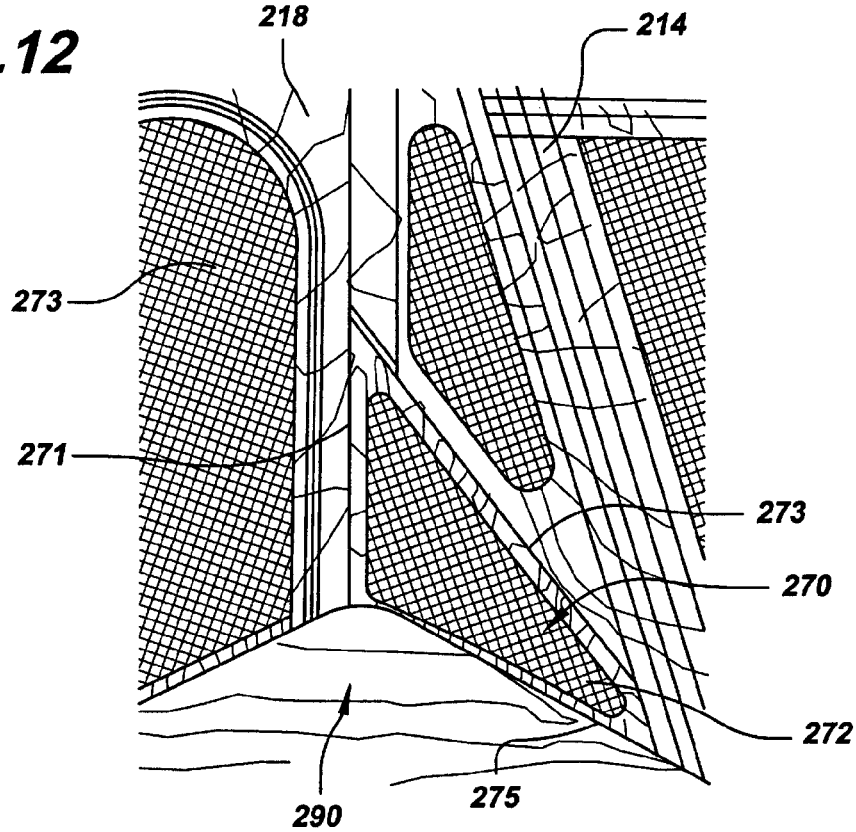
FIG. 12 is a partial front perspective view of the interior of the embodiment of FIG. 9 with the head end of the mattress reclined.

FIG. 12 further illustrates the attachment of a left side connecting panel 270 comprising mesh material 272 attached along seam 275 to the head end of the mattress cover 250 and along seam 271 to the head end wall 218. Seam 273 joins the third side of the connecting panel 270 to the left side separation panel, which extends from a lower portion of the side wall 214 located distally of the head end of the bed enclosure both upwardly and toward the head end of the bed enclosure until it meets the side edge of the side wall 214.

One of the advantages of this alternative embodiment, apart from the use of smaller connecting panels 260, is that pocket formed between the connecting panel and a side wall when the mattress cover 250 is articulated upward is smaller, leaving less space that an occupant can potentially become lodged between. This embodiment thus further reduces any risk of entrapment within the present bed enclosure.

Safety Panel

Figure 7:
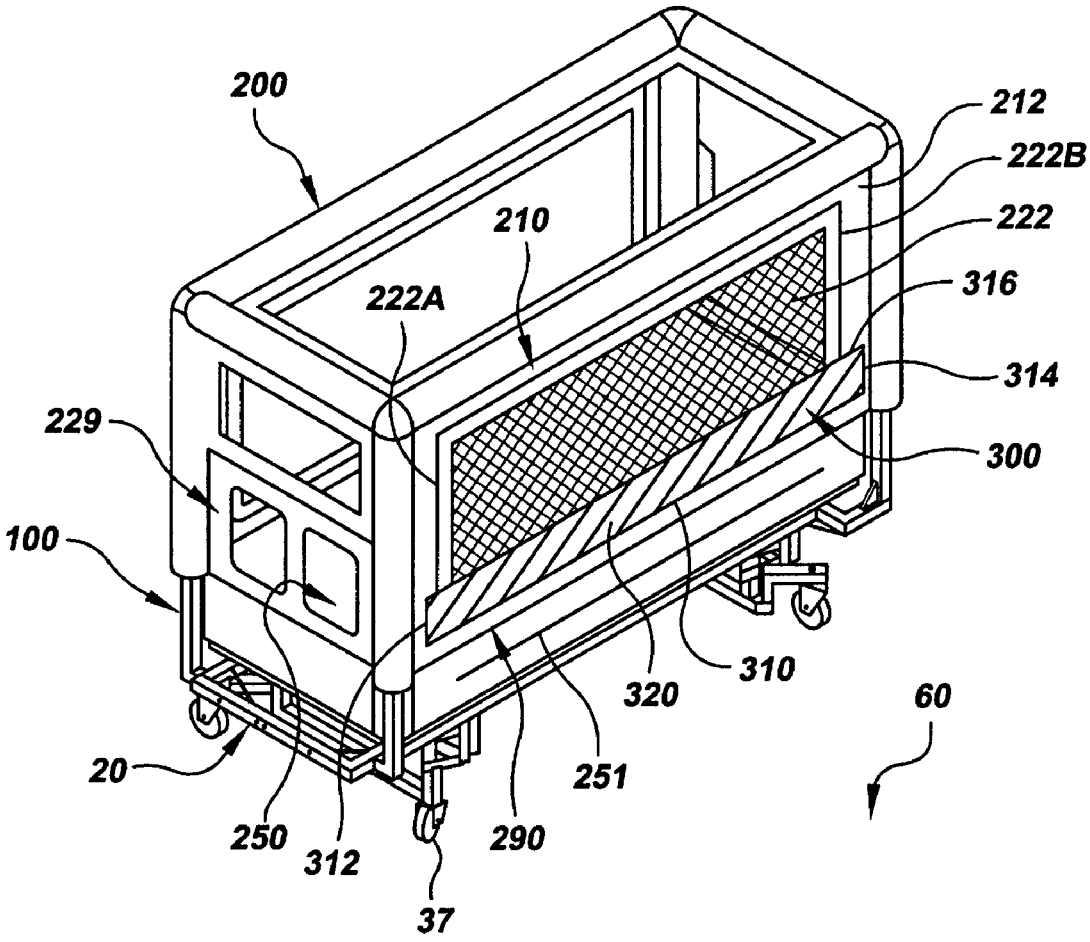
FIG. 7 is front a perspective view of the bed, frame, and tent of FIG. 2, further showing a safety panel attached to the tent.
Figure 8:
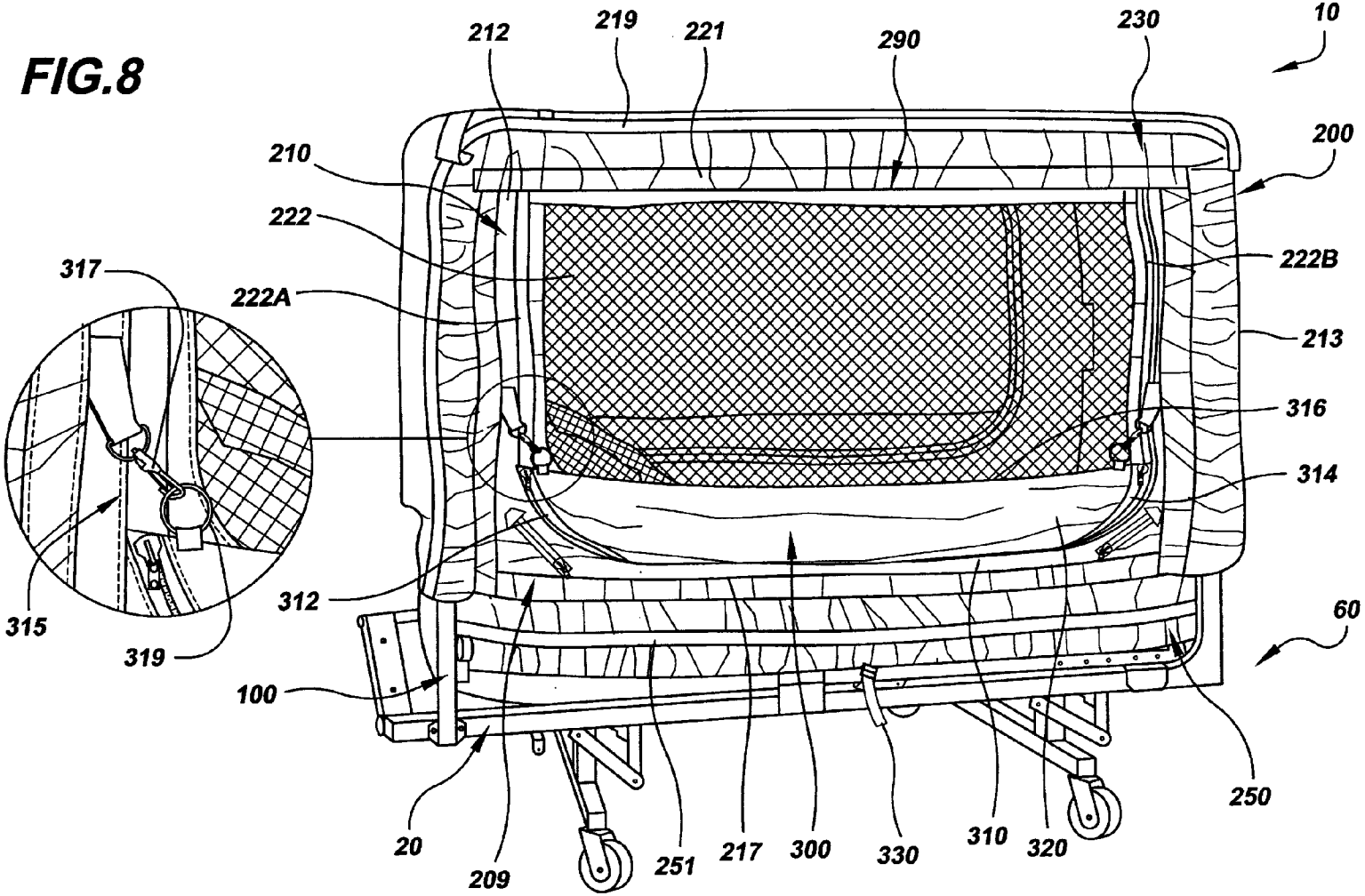
FIG. 8 is a front perspective view of the bed, frame, and tent of FIGS. 5 and 6 showing a safety panel attached to the tent.

In a preferred embodiment, best seen in FIGS. 7 and 8, the present bed enclosure includes a safety panel 300. The safety panel 300 comprises a flexible sheet of material, such as the material used to form tent walls 210, which is attached to a front face 290 of the tent, either to a tent wall 210 or to a side wall 253 of the mattress cover 250, preferably above the opening 251 for accessing the mattress 50. The safety panel 300 extends along the lower end of a tent wall below a window 220 in that wall 210, and can comprise a generally oblong or rectangular shape. The lower edge 310 of the safety panel 300 can be either reversibly attached, such as with a zipper, or can be more permanently attached to the tent, such as with stitching.

The safety panel 300 is adapted to be reversibly attached to a tent wall 210 (and also, preferably, to a portion of the mattress cover 250 if the edge 310 of the safety panel 300 is attached to the mattress cover 250) along two vertical edges 312 and 314. In the embodiment shown in FIGS. 7 and 8, the vertical edge 312 is attached to tent wall 212 adjacent the lower portion of vertical edge 222A of tent window 222, and vertical edge 314 of safety panel 300 is attached to the tent wall 212 adjacent the lower portion of vertical edge 222B of tent window 222. The vertical edges 312, 314 are configured to extend above the lower edge of a tent window.

The safety panel 300 further comprises an upper edge 316 extending between the vertical edges 312 and 314 so that the upper edge 316 is above the lower vertical extent of the tent window with which it is associated. As shown in FIGS. 7 and 8, the upper edge 316 on tent wall 212 is above the lower edge 222C (shown in FIG. 2) of the window 222, when the vertical edges 312 and 314 are attached to the tent wall 212. The upper edge 316 is thereby positioned above the lower vertical extent of a tent window 220.

The present safety panel 300 can be further secured at one or more longitudinal end to a tent wall 210 with a fastener 315. In the embodiment illustrated in FIG. 8, the fastener 315 comprises a ring 319 attached to the safety panel 300 and a catch 317 attached to the side wall 212. The catch is reversibly secured to the safety panel 300.

When the safety panel 300 is secured to tent wall 212 as shown in FIGS. 7 and 8, it serves to protect a patient located inside the tent 200 from falling out of the bed enclosure when the tent window 222 is open and thus serves a similar function to the side rails frequently provided with hospital beds. However, the present safety panel 300, unlike side rails, is not hard and therefore is less likely to injure a patient who comes into contact with it. Such safety panels are also lightweight and do not pose an entrapment risk to a patient.

A further advantage of the present safety panels 300 is that when the vertical sides 312 and 314 are not secured to the tent wall 210, the upper edge 316 of the safety panel 300 will lie below the lower edge 310 of the safety panel 300, and the safety panel 300 can in this case serve a decorative purpose, in the same manner as a bed skirt, by covering portions of the mattress cover 250 and/or the bed frame 20. The safety panel 300 can alternatively be folded or rolled up and secured to the tent wall 210 with which it is associated with straps, or can be stored in a pouch or pocket. In a further alternative, the safety panel 300 can comprise a reversible attachment along the lower edge 310 and be removable, e.g. for laundering. In addition, either or both of the sides 320 of the safety panel 300 can include decorative patterns in order to increase the aesthetic qualities of the present bed enclosure.

Although the present invention has been discussed in considerable detail with reference to certain preferred embodiments, other embodiments are possible. The steps disclosed for the present methods are not intended to be limiting nor are they intended to indicate that each step depicted is essential to the method, but instead are exemplary steps only. Therefore, the scope of the appended claims should not be limited to the description of preferred embodiments contained in this disclosure. All references cited herein are incorporated by reference to their entirety.

What is claimed is:

1. A bed enclosure supported by a frame, comprising:

a tent comprising a head end wall, a foot end wall, a right side wall, and a left side wall, each of the end walls and side walls comprising a lower edge and two side edges, wherein the side edges of each end wall are joined to at least a portion of one of the side edges of each of the side walls to form a four-sided enclosure;

a mattress cover joined to the lower edge of each of the end walls and side walls, the mattress cover having a head end, a foot end, a right longitudinal side extending between the head end and the foot end, and a left longitudinal side extending between the head end and the foot end, the mattress cover substantially completely covering an upper surface of the mattress;

a right side connecting panel comprising:

a first side attached to a first joining portion of the right longitudinal side of the mattress cover from the head end to a point located distally of the head end, the mattress cover not being attached to the tent right side wall along the first joining portion;

a second side attached to a second joining portion of a right side edge of a lower portion of the head end wall, the right side edge of the tent head end wall not being attached to the tent right side wall along the second joining portion; and a third side attached to the right side wall; and a left side connecting panel comprising:

a first side attached to a first joining portion of the left longitudinal side of the mattress cover from the head end to a point located distally of the head end, the mattress cover not being attached to the tent left side wall along the first joining portion;

a second side attached to a second joining portion of a left side edge of a lower portion of the head end wall, the left side edge of the tent head end wall not being attached to the tent left side wall along the second joining portion; and a third side attached to the left side wall.

2. The bed enclosure of claim 1, wherein the third side of the right side connecting panel is attached to a lower edge of the right side wall and wherein the third side of the left side connecting panel is attached to a lower edge of the left side wall.

3. The bed enclosure of claim 1, wherein the third side of the right side connecting panel is attached to the right side wall above a lower edge of the right side wall, and wherein the third side of the left side connecting panel is attached to the left side wall above a lower edge of the side wall.

4. The bed enclosure of claim 3, wherein the third side of the right side connecting panel is attached to a separation panel of the right side wall, and wherein the third side of the left side connecting panel is attached to a separation panel of the left side wall above a lower edge of the left side wall.

5. The bed enclosure of claim 4, further comprising an upper border window above the separation panel and a lower border window below the separation panel.

6. The bed enclosure of claim 1, wherein the connecting panels comprise a material having an elastic modulus which allows the breathing musculature of an occupant of the bed enclosure to deform the material by a sufficient amount to allow the occupant to breathe if the chest of the occupant is in contact with one of the connecting panels.

7. The bed enclosure of claim 1, wherein the connecting panels comprise a mesh material.

8. The bed enclosure of claim 1, wherein each of the end walls and side walls comprises an upper edge, further comprising a roof panel, wherein the upper edge of each of the end walls and side walls is joined to the roof panel.

9. The bed enclosure of claim 1, wherein the tent is supported above a bed frame, and wherein the bed frame comprises a support surface for a mattress covered by the mattress cover, the support surface comprising a head end which articulates vertically with respect to a support surface on which the bed enclosure is supported.

10. The bed enclosure of claim 1, wherein the mattress cover is secured to the frame by a strap attached to the mattress cover.

11. A bed enclosure supported by a frame, comprising:

a) a tent comprising side walls which forms an enclosure, wherein at least a first side wall includes an opening, defining a upper edge, a lower edge and two side edges, and a window located within the opening, the window defining a lower edge and two side edges extending upwardly from the lower edge that are respectively reversibly secured to the lower edge and two side edges of the opening in first side wall by a connector in order to allow the window to be opened so that an individual can pass through the window; and b) a flexible safety panel comprising a lower edge and an upper edge, the lower edge of the safety panel being secured to the first side wall of the tent below the lower edge of the window and portions of the upper edge of the safety panel being secured to the first side wall above the lower edge of the window such that the safety panel extends across and covers a portion of the opening above the lower edge of the opening.

12. The bed enclosure of claim 11, wherein the tent is attached at its lower end to a mattress cover, and wherein the lower edge of the safety panel is secured to a side wall of the mattress cover.

13. The bed enclosure of claim 12, wherein the mattress cover comprises an opening in the side wall, and wherein the lower edge of the safety panel is secured to the side wall above the opening.

14. The bed enclosure of claim 11, wherein the lower edge of the safety panel is reversibly secured to the tent.

15. The bed enclosure of claim 14, wherein the connector comprises a zipper connector, further comprising a fastener for attaching an upper end of at least one longitudinal side of the safety panel to an one end of the zipper connector.

16. A bed enclosure supported by a frame, comprising:

(a) a tent comprising a head end wall, a foot end wall, a right side wall, and a left side wall, each of the end walls and side walls comprising a lower edge and two side edges, wherein the side edges of each end wall are joined to at least a portion of one of the side edges of each of the side walls to form a four-sided enclosure;

(b) a mattress cover joined to the lower edge of each of the end walls and side walls, the mattress cover having a head end, a foot end, a right longitudinal side extending between the head end and the foot end, and a left longitudinal side extending between the head end and the foot end, the mattress cover substantially completely covering an upper surface of the mattress;

(c) a right side connecting panel comprising:

a first side attached to a first joining portion of the right longitudinal side of the mattress cover from the head end to a point located distally of the head end, the mattress cover not being attached to the right side wall along the first joining portion;

a second side attached to a second joining portion of a right side edge of a lower portion of the head end wall, the right side edge of the head end wall not being attached to the right side wall along the second joining portion; and a third side attached to the right side wall; and (d) a left side connecting panel comprising:

a first side attached to a first joining portion of the left longitudinal side of the mattress cover from the head end to a point located distally of the head end, the mattress cover not being attached to the left side wall along the first joining portion;

a second side attached to a second joining portion of a left side edge of a lower portion of the head end wall, the left side edge of the head end wall not being attached to the left side wall along the second joining portion; and a third side attached to the left side wall, wherein the third side of the right side connecting panel is attached to a separation panel in the right side wall above a lower edge of the right side wall, the right side wall further comprising an upper border window above the separation panel and a lower border window below the separation panel, and wherein the third side of the left side connecting panel is attached to a separation panel in the left side wall above a lower edge of the left side wall, the left side wall further comprising an upper border window above the separation panel and a lower border window below the separation panel.

17. The bed enclosure of claim 16, wherein the mattress cover is secured to the frame by a strap attached to the mattress cover.

18. The bed enclosure of claim 16, wherein the tent is supported above a bed frame, and wherein the bed frame comprises a support surface for a mattress covered by the mattress cover, the support surface comprising a head end which articulates vertically with respect to a support surface on which the bed enclosure is supported.

19. The bed enclosure of claim 16, wherein the connecting panels comprise a material having an elastic modulus which allows the breathing musculature of an occupant of the bed enclosure to deform the material by a sufficient amount to allow the occupant to breathe if the chest of the occupant is in contact with one of the connecting panels.

20. The bed enclosure of claim 16, wherein the connecting panels comprise a mesh material.

21. The bed enclosure of claim 16, wherein each of the end walls and side walls comprises an upper edge, further comprising a roof panel, wherein the upper edge of each of the end walls and side walls is joined to the roof panel.

* * * * *